United States Patent [19]

Hyvärinen

[11] Patent Number: 4,474,654

[45] Date of Patent: Oct. 2, 1984

[54] METHOD FOR REMOVING ARSENIC FROM A SULPHURIC-ACID SOLUTION

[75] Inventor: Olli V. J. Hyvärinen, Port, Finland

[73] Assignee: Outokumpu Oy, Helsinki, Finland

[21] Appl. No.: 519,822

[22] Filed: Aug. 3, 1983

[30] Foreign Application Priority Data

Aug. 27, 1982 [FI] Finland ..... 822982

[51] Int. Cl.[3] ..... C25C 1/12; C25C 1/22

[52] U.S. Cl. ..... 204/108; 204/105 R; 204/130; 204/400

[58] Field of Search ..... 204/130, 106–107, 204/108, 105 R, 128, 400, 434

[56] References Cited

U.S. PATENT DOCUMENTS 556,092 3/1896 Frölich ..... 204/111

OTHER PUBLICATIONS

Principles of Electroplating and Electroforming by W. Blum et al., 3rd ed., 1949, pp. 396–397.

E.M.F. Series of Elements, Handbook of Chem. & Physics, 32nd ed., Chem. Rubber Co., 1950, p. 1521.

*Primary Examiner*—R. L. Andrews

*Attorney, Agent, or Firm*—John Smith-Hill

[57] ABSTRACT

The present invention relates to a method for removing arsenic from a sulphuric-acid solution by electrolytically precipitating the solution. The employed current density is adjusted by observing the arsenic and copper contents of the solution with a solution analyser, so that operation takes place below the limiting current density peculiar to each system.

8 Claims, 2 Drawing Figures

METHOD FOR REMOVING ARSENIC FROM A SULPHURIC-ACID SOLUTION

The present invention relates to a method for removing arsenic from a sulphuric-acid solution. The method is particularly suitable for electrolytic purification of metals, where the commonest purified metal is copper. In electrolytic purification of copper, arsenic is dissolved into the electrolyte in a proportion which depends on the impurity level of the copper anodes. In order to control the contents of arsenic and other dissolved impurities, such as Ni, Fe, Zn, Co, Sb and Bi, the amount of purified electrolyte is determined according to the respective contents.

The commonest method for removing arsenic from an electrolyte solution is electrolyzing the solution in basins which are provided with insoluble lead anodes and copper cathodes. The electrolyte which is fed into the basins normally contains 40–50 g/l Cu, 150–200 g/l sulphuric acid, 1–15 g/l As, as well as varying amounts of other impurities. In the beginning of the electrolytic process, copper is precipitated from the solution onto the cathode. As soon as the solution is sufficiently poor in copper, arsenic starts to coprecipitate onto the cathode as well, and while the electrolysis is further continued, it is possible that highly poisonous hydrogen arsenide is developed on the cathode. The electrolysis is normally finished when the solution copper content reaches 1–0.5 g/l, in which case the solution is normally conducted into further processing, if it contains nickel, or into neutralization, or it is returned to copper electrolysis.

The purpose of the present invention is to achieve a method where the generation of hydrogen arsenide can be prevented without obstructing the precipitation of copper and arsenic onto the cathode.

According to the present invention there is provided a method for removing arsenic from a sulphuric-acid solution containing copper, particularly from a solution used in electrolytic purification of metals by electrolytic precipitation, comprising the step of adjusting the current density so that it does not exceed the limiting current density pertaining to the system, above which limiting current density hydrogen arsenide is generated.

BRIEF DESCRIPTION OF DRAWINGS

In the following the invention is explained in further detail with reference to the enclosed drawings, where.

DETAILED DESCRIPTION OF DRAWINGS

Figure 1:
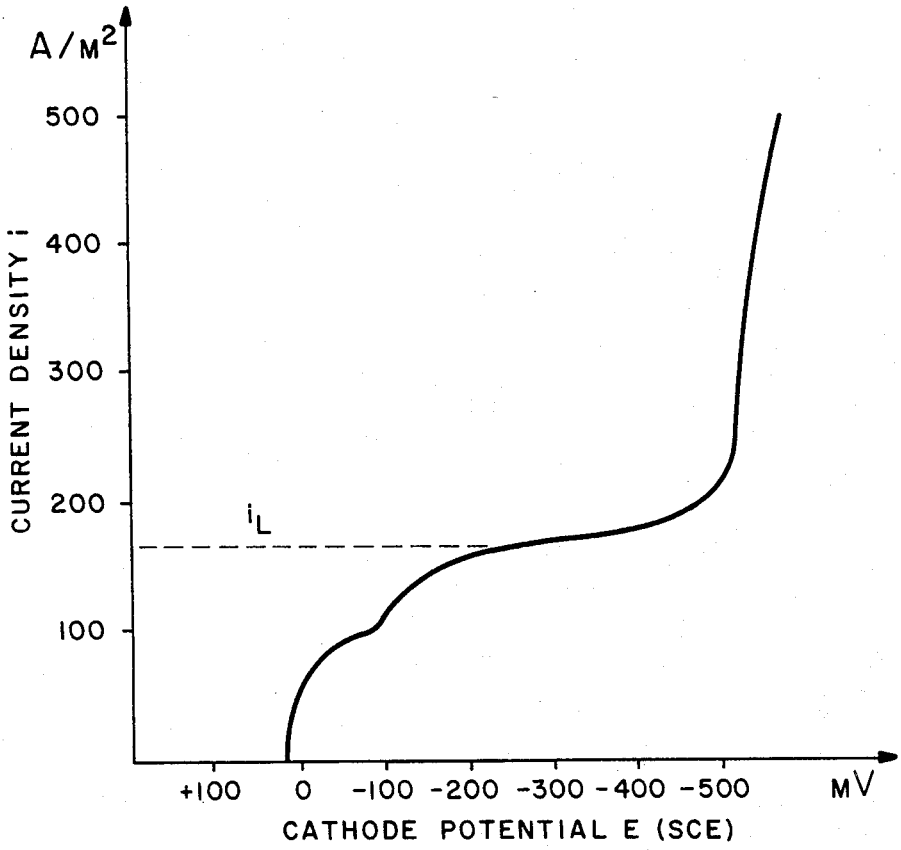
FIG. 1 illustrates the results of a laboratory-scale experiment on the dependence of the current density in copper and arsenic cathode precipitation on the cathode potential.

The results of the laboratory-scale experiment illustrated in FIG. 1 are surveyed below, the said results showing how the current density in copper and arsenic precipitation on the cathode is dependent on the cathode potential.

The solution contained 2 g/l Cu, 5 g/l As and 250 g/l sulphuric acid. The copper cathode and the lead anode were submerged into the solution, which was not stirred, at the temperature 45° C. The power generator charged into the electrolytic cell a current which grew from zero to 500 A/m$^2$ at a standard speed of 8.3 A/m$^2$s. The cathode potential was measured by employing a saturated calomel electrode (SCE) as the comparison electrode.

In the circumstances of FIG. 1, only copper is precipitated with a low current density $<100$ A/m$^2$. As the current density increases, the cathode overvoltage also increases allowing the following electrode process, which is the coprecipitation of arsenic with copper. As the current density further increases, the limiting current density $i_L$ is reached. This limiting current density stands for the highest copper and arsenic precipitation rate, in which case the speed of the whole reaction is controlled by the diffusion of arsenic and copper. If the current density is further increased, the electrode potential grows rapidly and reaches next the hydrogen discharge potential. Simultaneously with the hydrogen discharge, hydrogen arsenide is also discharged on the electrode.

In practice it is therefore necessary to operate with a current density which remains below the limiting current; in that case hydrogen arsenide is not generated. On the other hand, it is profitable to operate with a current density which climbs as near to the limiting current density as possible, because the equipment functions most efficiently when the precipitation rates of copper and arsenic are at their highest. It is pointed out that even if the limiting current density is surpassed, the precipitation rates of copper and arsenic do not grow, but the surpassing proportion is consumed in useless generation of hydrogen and in harmful generation of hydrogen arsenide.

Among the factors which determine the limiting current density are the copper and arsenic contents of the solution, the temperature and the fact whether the solution is stirred or not—i.e. such factors that enhance the diffusion of the reagent materials onto the cathode, also increase the limiting current density. Because the copper and arsenic contents are changed during the process, and the limiting current is changed accordingly, it is advantageous for the efficiency of the process to adjust the employed current density in proportion to the said changes. Let the following example illustrate this.

EXAMPLE 1

In industrial scale an electrolyte, which contained 44 g/l Cu, 8 g/l As, 17 g/l Ni and 182 g/l $H_2SO_4$, was conducted through two groups of copper extraction basins. Both groups consisted of 5 adjacent basins with 30 cathodes each. The employed current density was 180 A/m$^2$. In this case only copper was precipitated in compact form onto the cathode, and hydrogen arsenide was not generated when the copper content of the outcoming solution had decreased to 8 g/l. 51 m$^3$ of this solution was gathered into a circulation tank. The solution was circulated through the 10 adjacent basins at a speed of 3 m$^3$/h basin while the temperature was roughly 40° C. From the collecting pipe of the basin overflow, a sample was pumped into the continuous-operation Outokumpu Courier −30 X-ray analyser, which continuously measured the copper, arsenic, nickel, antimony and bismuth contents of the overflow. The basins were tightly covered with covering plates and air-conditioned with a particular exhaust blower. The exhaust gas pipe leading to the roof was provided with a Dräger hydrogen arsenide analyser.

When hydrogen arsenide was detected in the exhaust gases, the current density was decreased until the generation of hydrogen arsenide was finished. The electrolysis was carried on for 21 hours, during which time the copper content of the solution sank down to 0.5 g/l and the arsenic content to 4 g/l. Thereafter the electrolysis was completed and the solution was pumped into evaporation in order to extract nickel sulphate.

On the basis of this experiment it was possible to determine such a limiting current density for an experimental system, above which limiting current density hydrogen arsenide is generated. It was described as a dependent variable of the solution copper content, and the respective curve is illustrated in FIG. 2.

Figure 2:
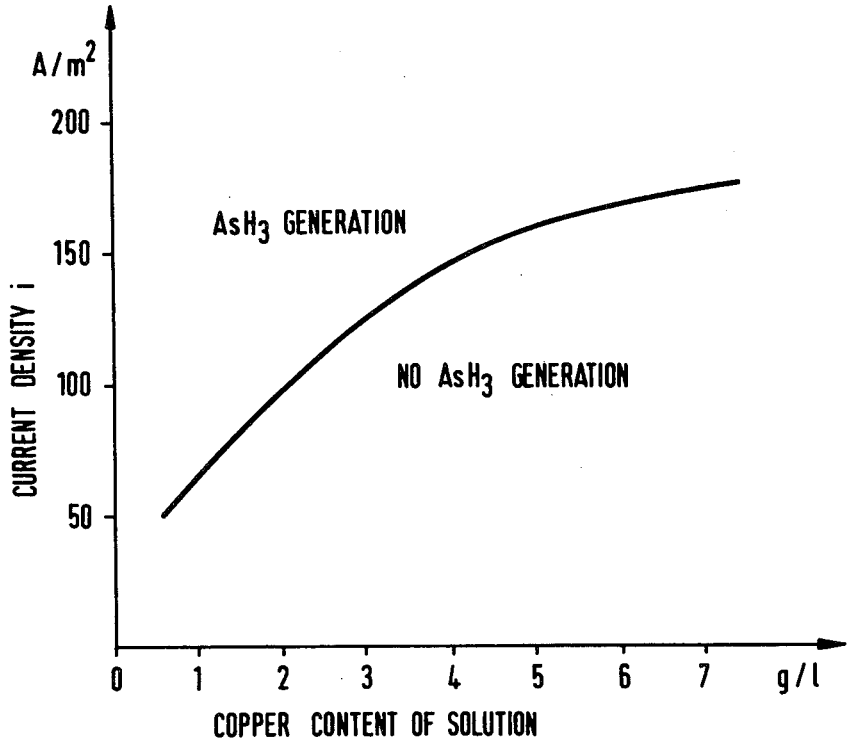
FIG. 2 illustrates the limiting current density of the employed system as the dependent variable of the solution copper content.

The current densities illustrated in FIG. 2 were programmed into a microprocessor connected to a continuous-operation solution analyser. Thereafter the microprocessor was switched on to control the current density of the respective basins according to the copper content obtained from the solution analyser. In the successive runs with new solutions, the hydrogen arsenide analyser did not detect any generation of hydrogen arsenide, but the process was carried out effectively, which could be observed from the extraction speed of copper and arsenic.

In principle the process control can also be arranged according to the cathode potential; if it is higher than −400 mV (SCE), hydrogen arsenide is not generated. In an industrial application, however, it is difficult to reliably measure representative cathode potentials of several basins. Cell voltage is comparable to cathode potential, but it is determined by many more factors than the cathode potential, wherefore it is even more unreliable from the point of view of control. A hydrogen arsenide detector is suitable for providing alarm but not very suitable for controlling the process. The process control is most profitably carried out according to the example, where the progress of the process is controlled by observing the contents of the solution.

In the example a feed-in process was used, where a given amount of solution was circulated until the desired Cu-content was achieved. The process can also be arranged in a continuous manner, in which case a solution analyser continuously analyses the contents of different stages, and the current is adjusted according to the said contents. It is naturally clear that various circumstances, such as flowing speed, temperature, content proportions in the solution, electrodes etc. each require an experimental determination of the control curve according to FIG. 2.

If the solution contains plenty of arsenic, for example more than 10 g/l, which should be totally eliminated, itis advisable to add some copper into the solution for example by adding some electrolyte, so that the copper content of the solution remains between 0.1 g/l and 3 g/l as long as the solution contains arsenic, because in this area the arsenic precipitation rate is at its highest; roughly 50–70% of the current is consumed for precipitating the arsenic. If the solution runs out of copper, the arsenic precipitation rate is decreased.

I claim:

1. A method for removing arsenic from a sulphuric-acid solution containing copper used in electrolytic purification of metals by electrolytic precipitation, comprising the steps of measuring the copper content of the solution, and adjustingthe current density in dependence upon the copper content of the solution so that it does not exceed the limiting current density pertaining to the system, above which limiting current density hydrogen arsenide is generated.

2. The method of claim 1, comprising adjusting the current density so that operation takes place near the limiting current density but still below it.

3. The method of claim 1 comprising observing the copper and arsenic contents of the solution by means of a continuous-operation solution analyser.

4. The method of claim 1, comprising maintaining the solution copper content higher than 0.1 g/l during the extraction of arsenic.

5. The method of claim 1, comprising determining the limiting current density of the system as a dependent variable of the copper content.

6. The method of claim 1, comprising continuously measuring the copper content of the solution.

7. The method of claim 6, wherein the copper content is measured using a continuous-operation solution analyser.

8. A method of removing arsenic from a sulphuric-acid solution containing copper used in electrolytic purification of metals comprising determining the limiting current density of the solution, above which limiting current density hydrogen arsenide is generated, as a dependent variable of the copper content of the solution, and subsequently electrolytically precipitating copper and arsenic from the solution by:

(a) measuring the copper content of the solution; and
(b) adjusting the density of the electrolysis current in dependence upon the copper content so that it does not exceed the limiting current density of the solution.

* * * * *